United States Patent [19]

Leonard

[11] 3,979,085

[45] Sept. 7, 1976

[54] GUIDED MISSILE USING FLUIDIC SENSING AND STEERING

[75] Inventor: John P. Leonard, Huntsville, Ala.

[73] Assignee: The United States of America as represented by the Secretary of the Army, Washington, D.C.

[22] Filed: Oct. 8, 1974

[21] Appl. No.: 513,015

[52] U.S. Cl. ..... 244/3.15; 244/3.22

[51] Int. Cl.[2] ..... F42B 15/18

[58] Field of Search ..... 244/3.15, 3.2, 3.21, 244/3.22

[56] References Cited

UNITED STATES PATENTS

| | | | |
|---|---|---|---|
| 2,951,659 | 9/1960 | Yoler | 244/3.22 |
| 3,113,520 | 12/1963 | Geissler et al. | 244/3.22 |
| 3,374,966 | 3/1968 | Howard | 244/3.22 |
| 3,502,285 | 3/1970 | Gambill | 244/3.22 |

*Primary Examiner*—Verlin R. Pendegrass
*Attorney, Agent, or Firm*—Nathan Edelberg; Jack W. Voigt; Robert C. Sims

[57] ABSTRACT

A missile using fluidic sensors for determination of net aerodynamic force and moment on the missile. The force and moment thus determined are processed and summed by fluidic amplifiers and integrators to provide control signals for fluidic thrusters or other steerers for the missile. The sensors are diametrically opposed pairs of pressure taps located axially and circumferentially in the missile skin. Net aerodynamic force on the missile is taken as the algebraic sum from all the sensors in a linear fluidic summer, and net aerodynamic moment is taken from the proportional sum of the sensors in accordance with their position along the axis of the missile. This proportional sum is made in a fluidic vortex summer.

5 Claims, 4 Drawing Figures

GUIDED MISSILE USING FLUIDIC SENSING AND STEERING

BACKGROUND OF THE INVENTION

Various devices are known for guidance and attitude control of guided missiles. Such devices include gyroscopes, accelerometers (gyroscopic and otherwise), compasses, and celestial navigators. These systems have such drawbacks as being complex, expensive, and may be suseptable to vibrations or (in systems using electronic amplifiers) nuclear bombardment. The instant invention, being fluidic in nature, avoids such drawbacks.

SUMMARY OF THE INVENTION

The invention is a total fluidic system for attitude directional control of a missile. Total aerodynamic forces and moments are determined from an array of fluid pressure taps or ports in the skin of the missile. Identical control systems are used in both the pitch and yaw control planes. The taps are arranged in diametrically opposed pairs, the pairs being distributed axially and circumferentially in the skin of the missile. The pitch sensor pair is located along the top and bottom quadrant line of the missile. The yaw sensor pair is located along the right and left quadrant lines. The net force is taken as the algebraic sum of all pressures and net moment is taken as the algebraic sum of weighted pressures, weight being dependent on distance of a pair of pressure taps from the center of gravity of the missile. The net moment is twice integrated and combined with the net force to provide a control signal to thrust defecting jets or the like to change missile attitude.

DETAILED DESCRIPTION OF THE INVENTION

Figure 1:
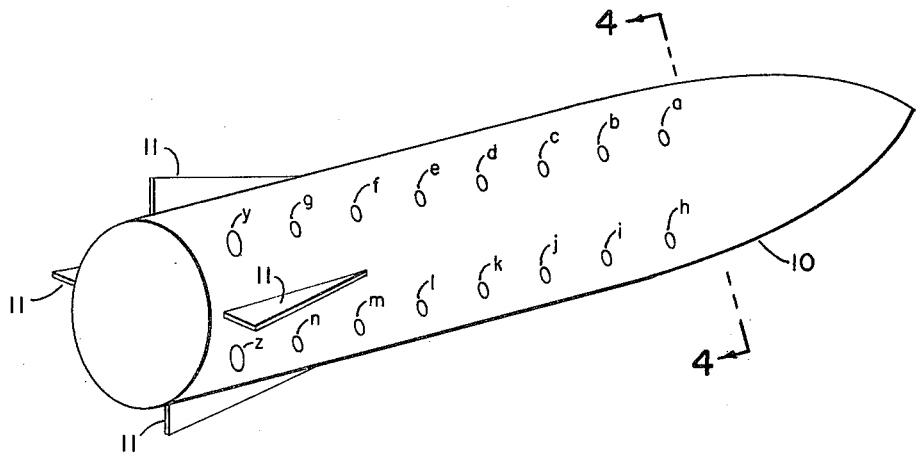
FIG. 1 shows a pictoral sketch of the missile made in accordance with the instant invention.

The equations describing planar missile moments and forces can be written as is shown in Equations (1) below.

$$\begin{aligned} &\Sigma M = 0 \quad J\ddot{\phi} + d\dot{\phi} + C_1\alpha + C_2\beta = 0 \quad (a) \\ &\Sigma F = 0 \quad m\ddot{x} + (T - D)\phi + C_3\alpha + C_4\beta = 0 \quad (b) \end{aligned} \qquad (1)$$

where $C_1 = C_n$ (CG-CP)

$C_2$ = (force per unit control deflection) (CG-CC)

$C_3 = C_{n\alpha}$ $C_4$ = force per unit control deflection d = missile damping coefficient $\beta$ = angle of control inflection $\alpha$ = angle of attack $\phi$ = missile attitude angle It should be noted that $d$, $C_{n\alpha}$ are functions of dynamic pressure and mach number and are usually nonlinear. The abbreviations CC, CG, and CP should be understood to respectively stand for center of control, center of gravity and center of pressure.

For the mathematics of the invention I make the following simplification of the above equations:

a. the point of application of control force (CC) will be taken as reference, thus CC is zero and CG and CP will be expressed in relationship to CC.

b. the moment $C_2\beta$ and force $C_4\beta$ due to control action will be written as though the controller were a direct force generator $C_2\beta = (CG - CC)\ Fc = CGFc$ [from (1) (*a*) above]

$C_4\beta = Fc$ c. $(C_1\alpha + d\Phi)$ is the total aerodynamic moment which will be designated Ma.

d. $(C_3\alpha)$ is the total aerodynamic force resultant which will be designated Ra.

Using the definitions *a* through *d* it is now possible to rewrite Equation (1).

$$\begin{aligned} &J\ddot{\phi} + Ma + Fc\ CG = 0 \quad (a) \\ &m\ddot{x} + (T - D)\phi + Ra + Fc = 0 \quad (b) \end{aligned} \qquad (2)$$

Solving equation (2) (*a*) for $\Phi$ yields $$\phi = -\frac{Ma}{J} - \frac{Fc\ CG}{J} \qquad (3)$$

Inserting Equation (3) into (2) (*b*) yields $$m\ddot{x} + (T-D) - \frac{Ma}{J} - \frac{Fc\ CG}{J} dt\ dt + Ra + Fc = 0 \qquad (4)$$

$x$ will go to zero if the following condition is satisfied:

$$-(T-D)\frac{Ma}{J} dt\ dt + Ra = (T-D)\frac{Fc\ CG}{J} dt\ dt - Fc \qquad (5)$$

Let $T\text{-}D/J = k_1$ and rearranging, $$-k_1(Ma + Fc\ CG)dt\ dt + (Ra + Fc) = 0 \qquad 6.$$

or in Laplace notation $$Fc = \frac{K_1}{S^2 - K_1 CG} Ma - \frac{S^2 Ra}{S^2 - K_1 CG} \qquad (7)$$

Clearly, the required control force to maintain zero lateral acceleration is a function of only CG location, (T-D) and 1/J, the initial $\phi$ and Ma and Ra, all of which are either well behaved or measured.

This situation is considerably different from that obtained when control is referenced to a quantity such as angle of attack. In that case the gains must explicitly or implicity include functions of dynamic pressure, mach number and center of pressure. My invention employs moment resultant control (MRC) and requires much less optimization in terms of response characterstics than does a control scheme based upon angle of attack alone.

It should be noted however that the performance of MRC is no better than that of an alpha control scheme with instantaneously optimized gains. In fact they are identical. The MRC approach of my invention is advantageous in that it avoids the requirement for critical matching.

From the above equations and knowledge of pressure distribution along the longitudinal axis on a missile, the resultant force, Ra of the pressure distribution is the product of the effective area of the missile skin and the pressure per unit area, or $$Ra = PdA \qquad 8.$$

where P is absolute pressure, and A is total area. This integral can be defined as $$Ra = \Sigma P \Delta A \qquad 9.$$

where $$\Delta A = 1 \Delta x \qquad 10.$$

and 1 = width of a unit area and $x$ = length along the longitudinal axis of the missile. Thus:

$$Ra = l \sum_{i=l}^{n} Pi \Delta xi \qquad (11)$$

The total moment produced by aerodynamic forces is defined as:

$$Ma = xPdA \qquad 12.$$

$$\text{or } Ma = l \sum_{i=l}^{n} x_i Pi \Delta xi$$

For simplicity, one might consider the case where pressure is sampled over equal intervals along the body. This is by no means a requirement and it will be shown later that certain advantages accrue from selective distribution of pressure sensing locations. Then:

$$Ra = \Delta xil \, \Sigma Pi \qquad 13.$$

$$Ma = 1 \, \Sigma \, i \, \Delta xi \, \Delta xi \, Pi \qquad 14.$$

if $xi = i\Delta_{xi}$ $$Ma = l \, \Delta xi^2 \sum_{i=l}^{n} i \, Pi \qquad (15)$$

Letting $$\lambda_1 = \Delta xil \text{ and } \lambda_2 = \Delta xi^2 \, l,$$

we obtain:

$$Ra = \lambda_1 \, \Sigma Pi \qquad 16.$$

$$Ma = \lambda_2 \, \Sigma iPi \qquad 17.$$

Figure 3:
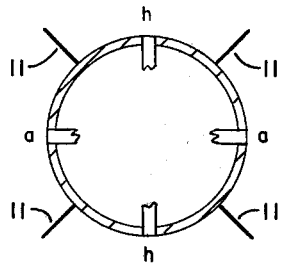
FIG. 3 is a schematic showing of an end sectional view of the missile in direction 4—4 of FIG. 1, showing the positions of the pressure taps in the skin of the missile.
Figure 4:
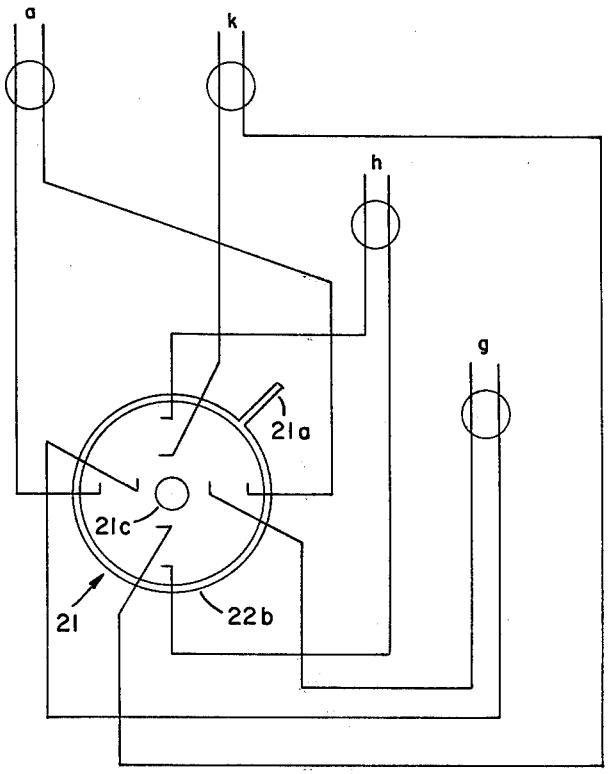
FIG. 4 is a schematic showing of the fluidic vortex summer of the invention.

The mathematical concepts of the invention may be mechanized as shown schematically in the drawings. As shown in FIG. 1, pressure taps a–h are made in the skin of missile 10. These taps are arranged in diametrically opposed pairs as may be seen in the sectional view of FIG. 3. Missile 10 is shown as having fins 11, although a particular missile may not have such fins. In FIG. 4, pairs of taps a—a and h—h can be seen. The invention is not concerned with the absolute pressure on either tap of the pairs of taps per se, but on the pressure differential Pi across the taps. Typical tap pairs would be constructed of 20 taps in each strip of the pair.

Figure 2:
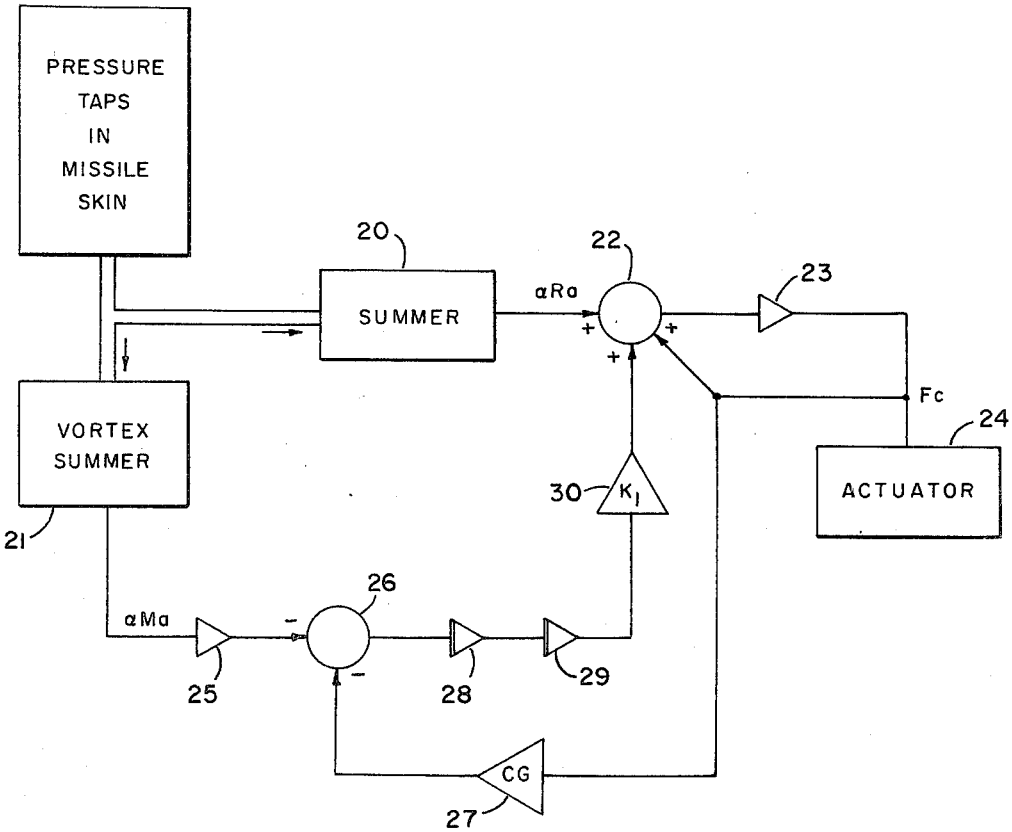
FIG. 2 is a schematic diagram of the fluidic system of the invention.

Referring now to the inventive system as shown in FIG. 2, the various pressure taps are connected by fluid conduits to summer 20. Summer 20 may include individual linear fluidic amplifiers for each pair of the pressure tap pairs, with opposite taps of a pair feeding opposite fluid control ports of a particular fluidic amplifier. The outputs of the individual fluidic amplifiers may then be summed in a fluidic amplifier having control inputs equal to the number of individual amplifiers. Alternatively, a single fluidic amplifier having control inputs equal to the number of pressure taps may be used. In any event, 20 has an output proportional to Ra, its exact relation to Ra being dependent on the gain of the amplifier(s) in 20. The output of 20 can thus be called the pneumatic analog of the sum of all pressure tap pairs.

The determination of moment Ma uses the same pressures as does Ra but each must be scaled by the appropriate moment arm to the pressure. This is accomplished by direct pneumatic means. One effective way of accomplishing this is by use of a pneumatic vortex amplifier. Flow introduced from the outer radius of a vortex amplifier, if undisturbed, proceeds directly to the sink in the center and exits without any swirling motion. If however a flow is introduced at some point P, $r$ away from the center, a vortex is generated which can be measured and which is proportional to the produce of the distance from the center of the amplifier and the tangential momentum of the flow. This device provides exactly the information required to accomplish the moment calculation. By selecting a series of points to inject flow placed at radii which are analogous to the displacement of the pressure sensor (tap) along the body we can effectively generate an output of the vortex amplifier which is directly proportional to the aerodynamic moment. In FIG. 2, vortex amplifier 21 having inputs equal to the number of pressure taps acts as a summer. The manner by which moment arm is accommodated is shown in FIG. 4. Summer 21 is fed by fluid pressure through conduit 21*a* feeding porous ring 22*b*. With no inputs from control inputs, fluid will flow radially in 21 and exit at 22*c*. The various pairs to pressure taps are connected by fluid conduits to corresponding control inputs in 20, i.e., those pairs of taps close to the CG are close to 21*c* (as for example g—g) and those further from the CG are further away from 21c (as a—a). Opposite ones of each pair of control inputs are so arranged that they impart opposite vorticities to the radial flow in 21. That is, both control inputs for a pair of pressure taps point in the same direction, as may be schematically seen in the drawing. The output of 21 is thus proportional to Ma, the exact proportion being dependent on the gain of 21.

Referring again to FIG. 2, the output of summer 20 is applied as a positive input to summing junction 22. The output of 22 is amplified in fluidic amplifier 23 to provide signal Fc to actuator 24. Actuator 24 may be fluidic in nature (although not necessarily so) and may include thrust jets having ports $y$ and $z$ in the skin of missile 10 (see FIG. 1). The Fc signal is also fed back as a positive input to summing junction 22.

The signal from summer 21 is amplified in fluidic amplifier 25 and is applied as a negative input to summing junction 26. Also applied to 26 is a negative input from fluidic CG amplifier 27, the input to 27 being Fc. The output of 26 is twice integrated by integrators 28 and 29 and amplified by fluidic amplifier 30 having gain $k_1$. The output of $k_1$ is applied as a positive input to summing junction 22. For the system of FIG. 2, the following equation may be written:

$$-k_1\,(Ma + FcCG)dtdt + (Ra + Fc) = 0 \qquad 18.$$

Although not shown in FIG. 2, it should be understood that each of 20-30 inclusive is fed power jet fluid from a fluid source. The FIG. 2 system is so organized that it is quite tolerant of source pressure variations. If the Ma, Ra and Fc sensors and summing juctions are designed to have sensitivities matched to source pressure, the behavior of the loop will be substantially independent of supply pressure.

As concerns the pressure taps, naturally a minimum number of taps is desirable, but since an accurate representation of pressure distribution is required, the location of the taps is of some concern. The strongest factor which will determine number and location of sensors is the accuracy of the pressure and pressure moment summations with respect to the true integral. This consideration will be influenced by the change in the curve shape throughout the range of mach numbers, dynamic pressures and angles of attack. In regions having wide or unsmooth pressure distributions pressure sensors would be closely grouped. It is anticipated that in application to a particular missile the distribution of sensors would be optimized to match wind tunnel test data, with several sensors located on the tail surfaces.

Roll coupling presents the same problem in MRC as it does in directional control and alpha control. It is anticipated that a fixed sensor lead will be used to accommodate lags.

The Ma and Ra sensors both suffer from pressure transmission delays proportional to the displacement of the sensor from the pneumatic summing amplifier. If this proves to be a problem in a particular application, a simple solution is to delay all signals the same amount by making the tube length for all sensors the same. Another approach is to design a sensor with all tubes having the same l/D ratio.

The MRC equations as presented in equation 18 implicitly use the measurement of force and moment to effectively cancel the (T–D) $\Phi$ contribution to the track motion as well as achieving a satisfactory balance of Ra and Fc.

Although FIG. 2 shows a single channel, it should be understood that each control channel independently drives a thruster pair (24) oriented to develop reaction forces in their respective sensing plane. Amplifier 25 provides a scaling factor between Ma and Ra.

I claim:

1. An attitude control system for a missile having attitude control means, the invention comprising: means for determining net aerodynamics force on said missile; means for determining net aerodynamic moment on said missile; an attitude control system connected to the said means; each of said means for determining and said attitude control system are fludic; said means for determining net aerodynamic force includes pressure taps distributed in the skin of said missile; fludic means for algebraically summing the pressure from said taps; said means for determining net aerodynamic moment includes fluidic means for algebraically summing weighted pressures from said taps; said attitude control system includes: first and second fluidic summing junctions each having inputs and an output; fluidic attitude changing means having a fluid input connected to the output of said first fluidic summing junction; wherein each of said means for determining has an output; first means for connecting the output of said means for determining net aerodynamic force to a first fluid input of said first fluidic summing junction; second means connecting the output of said means for determining net aerodynamic moment to a first fluid input of said second fluidic summing junction; third means connecting said output of said second fluidic summing junction to a second fluid input of said first fluidic summing junction; and fourth means connecting said output of said first fluidic summing junction to a third input of said first fluidic summing junction and to a second input of said second fluidic summing junction.

2. The system as defined in claim 1 wherein said first means for connecting is a fluid conduit, said second means connecting in a first fluidic amplifier, said third means connecting is the cascaded connection of two fluidic integrators and a second fluidic amplifier, and said fourth means connecting incudes a third fluidic amplifier.

3. The system as defined in claim 2 wherein said fluidic attitude changing means is connected to the output of said first fluidic summing junction by third fluidic amplifier means having a fluid input connected to said output of said first fluidic summing junction and a fluid output connected to said fluid input of said fluidic attitude changing means.

4. The system as defined in claim 3 wherein said third fluidic amplifier is connected between said output of said third fluidic amplifier and said second fluid input of said second fluidic summing junction.

5. The system as defined in claim 4 wherein said means for determining net aerodynamic moment is a fluidic vortex amplifier having fluid control inputs equal to the number of said pressure taps and having a fluid output connected to said second means connecting, wherein said pressure taps are arranged in diametrically opposed pairs in the skin of said missile, and said pairs are distributed axially and circumferentially in the skin of said missile, and wherein said inputs of said vortex amplifier are arranged in opposed pairs connected to respective opposed pairs of pressure taps and are further distributed along the radius of said vortex amplifer in accordance with the distribution of said pressure taps axially in said missile skin.

* * * * *